US007669250B2

(12) United States Patent
Baron et al.

(10) Patent No.: US 7,669,250 B2
(45) Date of Patent: Mar. 2, 2010

(54) ARTICLE OF APPAREL INCORPORATING AN EMBOSSED MATERIAL

(75) Inventors: Michael Robert Baron, Tigard, OR (US); Karin Elizabeth Carter, Portland, OR (US); Chia Pei C. Hung, Mt. Laurel, NJ (US); Carrie Lynn Davis, Portland, OR (US); Rebecca P. Hurd, Tigard, OR (US); LaShurya M. Wise, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 762 days.

(21) Appl. No.: 10/963,745

(22) Filed: Oct. 14, 2004

(65) Prior Publication Data

US 2006/0080754 A1 Apr. 20, 2006

(51) Int. Cl.
*A41D 3/02* (2006.01)

(52) U.S. Cl. ..... 2/85; 2/69

(58) Field of Classification Search ..... 2/85, 2/69, 106, 108, 115, 113
See application file for complete search history.

(56) References Cited

U.S. PATENT DOCUMENTS 2,897,508 A * 8/1959 Bashore et al. ..... 2/93
3,219,514 A * 11/1965 Struycken de Roysancour ..... 428/175
3,542,616 A * 11/1970 Cain et al. ..... 156/224
4,536,431 A 8/1985 Wyckoff
4,690,847 A * 9/1987 Lassiter et al. ..... 428/71
4,913,911 A 4/1990 Wildt
5,643,653 A * 7/1997 Griesbach et al. ..... 428/120
5,913,406 A * 6/1999 Lofgren et al. ..... 2/51
6,554,963 B1 4/2003 Botelho et al.
2003/0203691 A1 * 10/2003 Fenwick et al. ..... 442/327

FOREIGN PATENT DOCUMENTS

GB 1 094 893 12/1967

OTHER PUBLICATIONS

International Search Report in corresponding PCT application, International Application No. PCT/US2005/036257, mailed Feb. 17, 2006.

* cited by examiner

*Primary Examiner*—Gary L Welch
*Assistant Examiner*—Alissa J Tompkins
(74) *Attorney, Agent, or Firm*—Banner & Witcoff, Ltd

(57) ABSTRACT

An embossed material and an article of apparel incorporating the embossed material are disclosed. The embossed material includes a textured surface that defines a plurality of extended regions and at least one compressed region. The extended regions may have an elongate or elliptical configuration, for example, and the compressed region may extend around each extended region. When incorporated into the article of apparel, the textured surface may face inward to form at least a portion of an interior surface of the article of apparel. Accordingly, the extended regions may be positioned to contact an individual wearing the article of apparel.

25 Claims, 7 Drawing Sheets

ARTICLE OF APPAREL INCORPORATING AN EMBOSSED MATERIAL

BACKGROUND OF THE INVENTION

1. Field of the Invention

The present invention relates to materials for articles of apparel. The invention concerns, more particularly, an embossed material that is suitable for use in articles of apparel. The invention has application, for example, to articles of apparel intended for use during athletic activities.

2. Description of Background Art

Articles of apparel designed for use during athletic activities generally exhibit characteristics that enhance the performance or comfort of an individual. For example, apparel may incorporate an elastic material that provides a relatively tight fit, thereby imparting the individual with a lower profile that minimizes wind resistance. Apparel may also be formed from a material that wicks moisture away from the individual in order to reduce the quantity of perspiration that accumulates adjacent to the skin. Furthermore, apparel may incorporate materials that are specifically selected for particular environmental conditions. Accordingly, materials incorporated into articles of apparel for athletic activities may be specifically selected to enhance the performance or comfort of the individual.

The characteristics of the materials that are incorporated into an article of apparel are generally selected based upon the specific activity for which the article of apparel is intended to be used. A material that minimizes wind resistance, for example, may be suitable for activities where speed is a primary concern. Similarly, a material that reduces the quantity of perspiration that accumulates adjacent to the skin may be most appropriate for athletic activities commonly associated with a relatively high degree of exertion. Accordingly, materials may be selected to enhance the performance or comfort of individuals engaged in specific athletic activities.

Textiles area a commonly-utilized class of materials for articles of apparel. Textiles may be defined as any manufacture from fibers, filaments, or yarns characterized by flexibility, fineness, and a high ratio of length to thickness. Textiles generally fall into two categories. The first category includes textiles produced directly from webs of fibers by bonding, fusing, or interlocking to construct non-woven fabrics and felts. The second category includes textiles formed through a mechanical manipulation of yarn, thereby producing a woven fabric.

Yarn is the raw material utilized to form textiles in the second category and may be defined as an assembly having a substantial length and relatively small cross-section that is formed from at least one filament or a plurality of fibers. Fibers have a relatively short length and require spinning or twisting processes to produce a yarn of suitable length for use in textiles. Common examples of fibers are cotton and wool. Filaments, however, have an indefinite length and may merely be combined with other filaments to produce a yarn suitable for use in textiles. Modern filaments include a plurality of synthetic materials such as rayon, nylon, polyester, and polyacrylic, with silk being the primary, naturally-occurring exception. Yarn may be formed from a single filament or a plurality of individual filaments grouped together. Yarn may also include separate filaments formed from different materials, or the yarn may include filaments that are each formed from two or more different materials. Similar concepts also apply to yarns formed from fibers. Accordingly, yarns may have a variety of configurations that generally conform to the definition provided above.

The various techniques for mechanically manipulating yarn into a textile include interweaving, intertwining and twisting, and interlooping. Interweaving is the intersection of two yarns that cross and interweave at substantially right angles to each other. The yarns utilized in interweaving are conventionally referred to as warp and weft. Intertwining and twisting encompasses procedures such as braiding and knotting where yarns intertwine with each other to form a textile. Interlooping involves the formation of a plurality of columns of intermeshed loops, with knitting being the most common method of interlooping.

The manner in which a textile is formed, and the specific yarns incorporated into the textile, affect the characteristics of the textile and the suitability of the textile for use in articles of apparel for athletic activities. A tight weave, for example, may not be sufficiently permeable to permit the removal of perspiration. A tight weave, however, may be sufficient to block wind or precipitation. Accordingly, the suitability of a particular textile depends upon various factors relating to the particular activity and environmental conditions associated with the activity.

SUMMARY OF THE INVENTION

One aspect of the present invention is an embossed material formed from a two-dimensional material, such as a textile. The embossed material may have a first surface and an opposite second surface. The second surface may define a plurality of extended regions that form protrusions. In addition, the second surface may define at least one compressed region that forms an indentation. The compressed region may extend around the extended regions. In addition, the extended regions may exhibit an elongate or elliptical configuration.

Another aspect of the invention is an article of apparel that includes the embossed material. The embossed material may be incorporated into the article of apparel such that the extended regions face inward to form at least a portion of an interior surface of the article of apparel. In this configuration, the extended regions are positioned to contact an individual wearing the article of apparel, and the embossed material may form a space between the individual and the compressed region.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1:
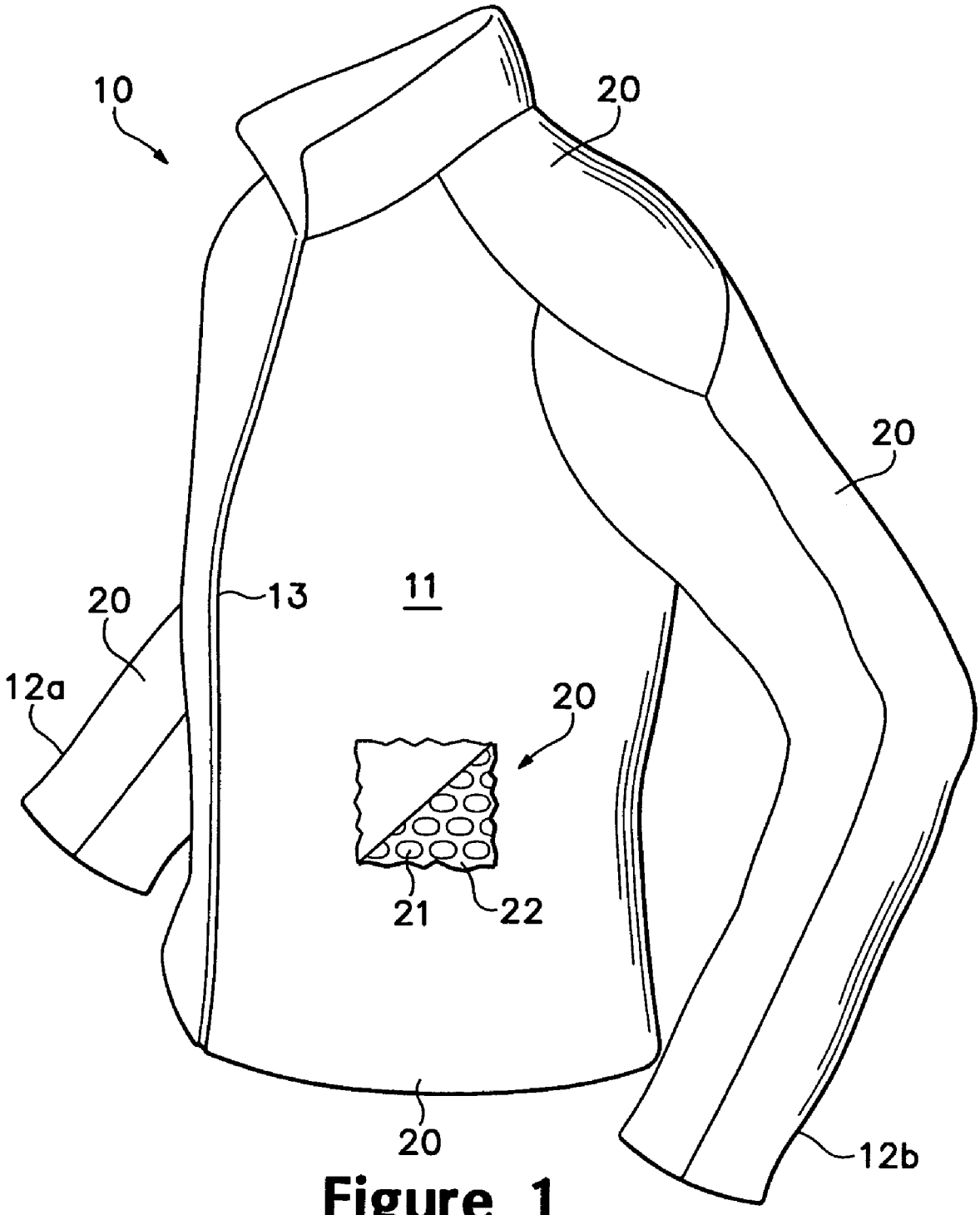
FIG. 1 is a perspective view of an article of apparel incorporating a material in accordance with the present invention.

The following discussion and accompanying figures disclose an article of apparel 10 at least partially formed from an embossed material 20, in accordance with the present invention. Article of apparel 10 is depicted in FIG. 1 as having the general configuration of a conventional jacket, with the exception of embossed material 20. One skilled in the relevant art will recognize, however, that embossed material 20 may be incorporated into a plurality of articles of apparel exhibiting a variety of different configurations, including long-sleeved and short-sleeved shirts, headwear, coats, pants, underwear, gloves, socks, and footwear, for example. Accordingly, the various concepts disclosed in the following discussion and accompanying figures with respect to article of apparel 10 may be utilized in connection with a variety of apparel configurations, in addition to a jacket.

Article of apparel 10 includes a torso portion 11 and two arm portions 12*a* and 12*b*. Torso portion 11 corresponds with a torso of an individual and, therefore, covers the torso when worn. Similarly, arm portions 12*a* and 12*b* respectively correspond with a right arm and a left arm of the individual and cover the arms when worn. A zipper 13 extends vertically through torso portion 11 to provide the individual with access to article of apparel 10. In addition, zipper 13 provides the individual with a structure for regulating the thermal properties of article of apparel 10. That is, zipper 13 may be opened to facilitate air flow and release heat, or closed to limit air flow. Article of apparel 10 exhibits, therefore, the general configuration of a conventional jacket. In contrast with the conventional jacket, however, article of apparel 10 is at least partially formed from embossed material 20.

Figure 2:
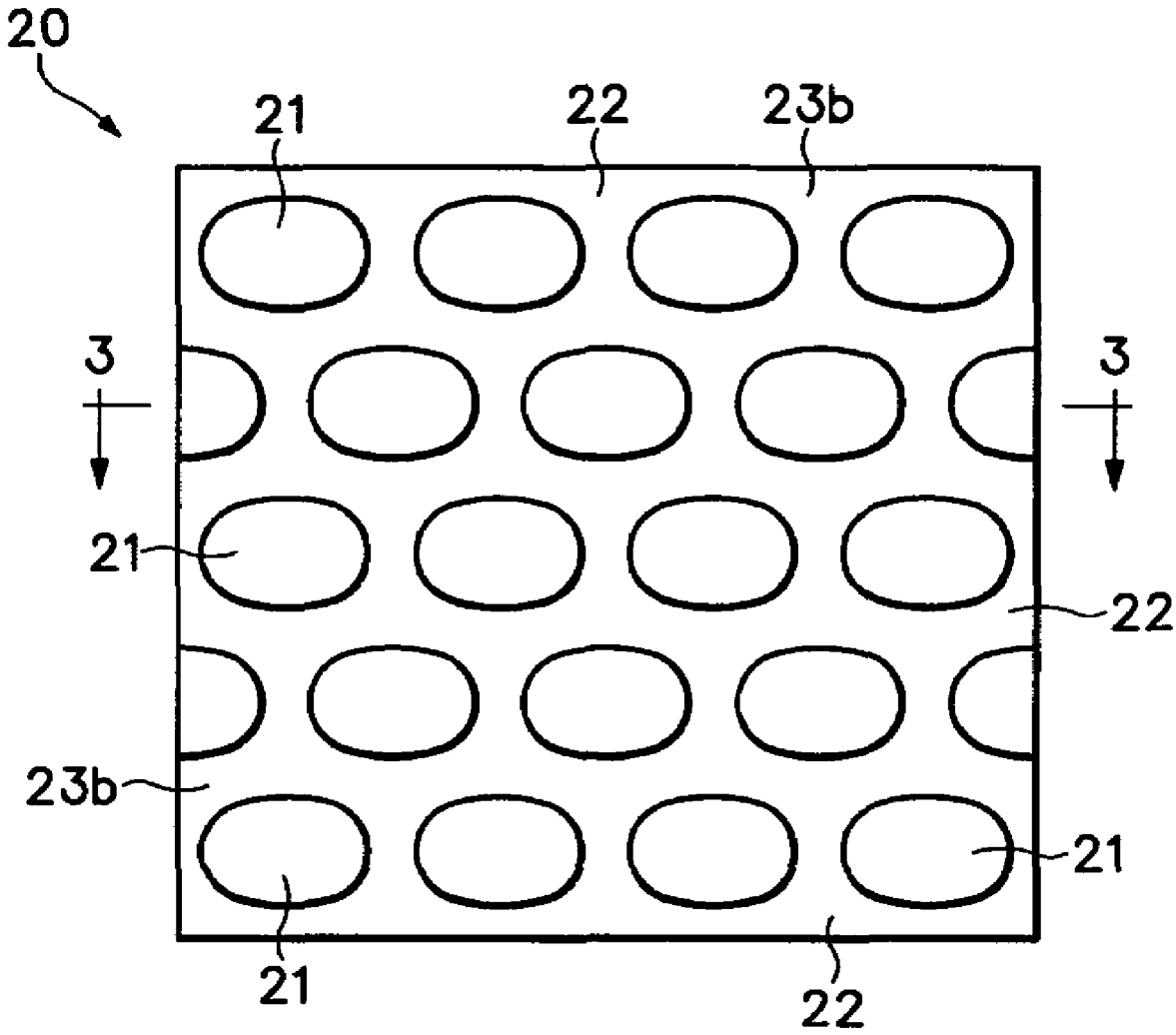
FIG. 2 is a plan view of a portion of the material.
Figure 3:
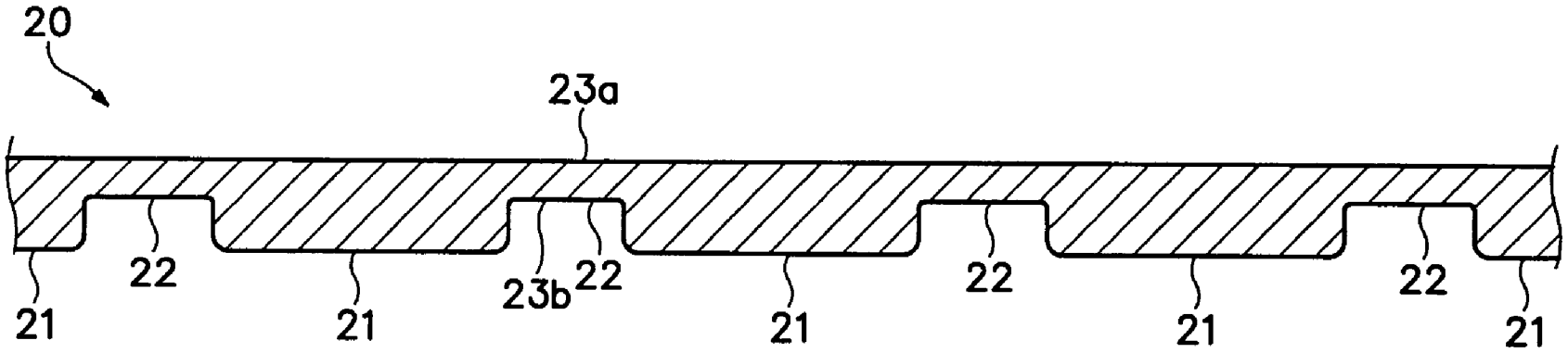
FIG. 3 is a cross-sectional view of the material, as defined by section line 3-3 in FIG. 2.

The primary elements of embossed material 20 are a plurality of extended regions 21 and a plurality of compressed regions 22, as depicted in FIGS. 2 and 3. Embossed material 20 may be a textile or a polymer sheet, for example, that has a first surface 23*a* and an opposite second surface 23*b*. Extended regions 21 form protrusions in embossed material 20 that exhibit a perpendicular or otherwise substantially orthogonal orientation with respect to first surface 23*a*. Correspondingly, compressed regions 22 form indentations in embossed material 20. Accordingly, embossed material 20 has a configuration wherein second surface 23*b* exhibits a textured structure due to extended regions 21 and compressed regions 22.

Figure 4:
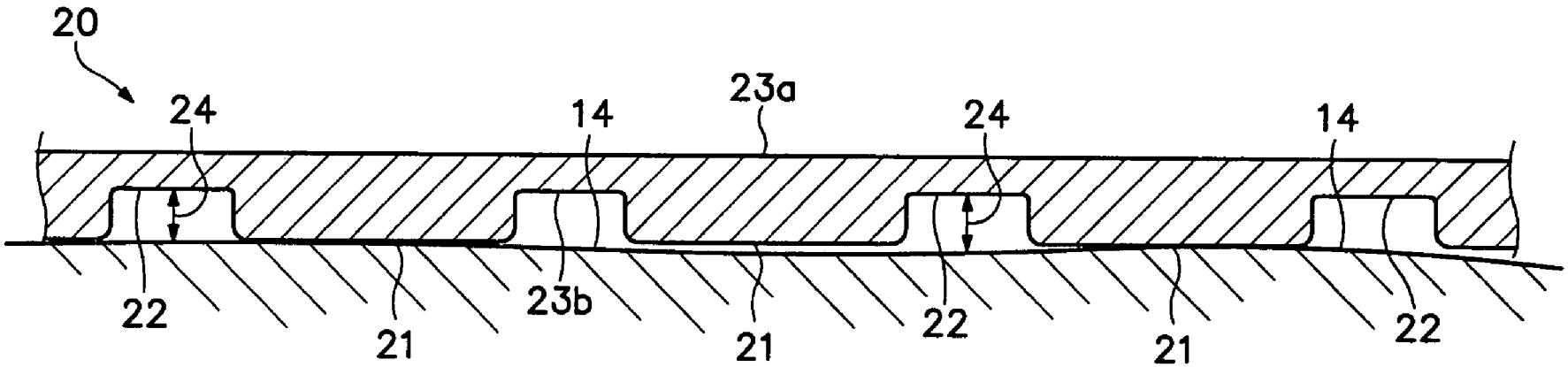
FIG. 4 is another cross-sectional view of the material that corresponds with FIG. 3 and depicts the textile as being in contact with an individual.
Figure 5A:
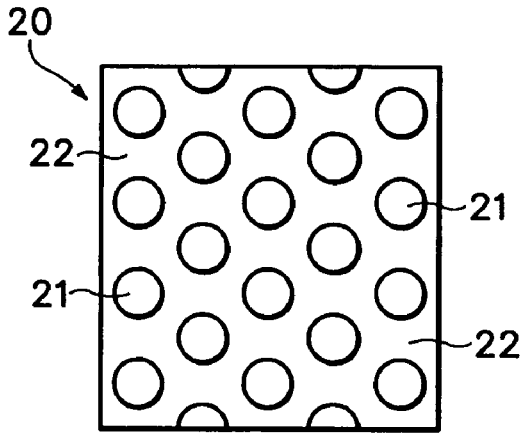
FIGS. 5A-5H are plan views depicting various additional configurations for the material.
Figure 5B:
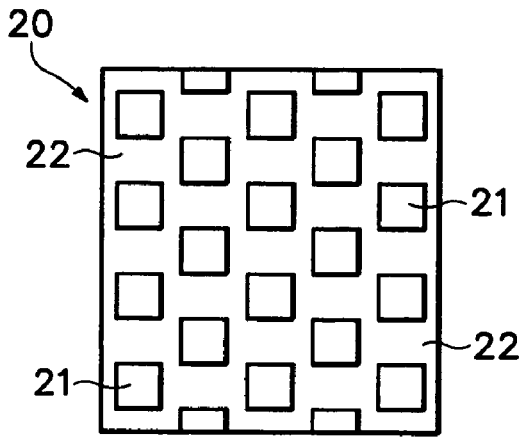
Figure 5C:
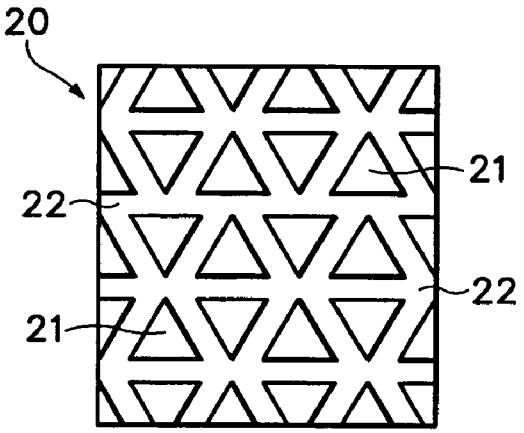
Figure 5D:
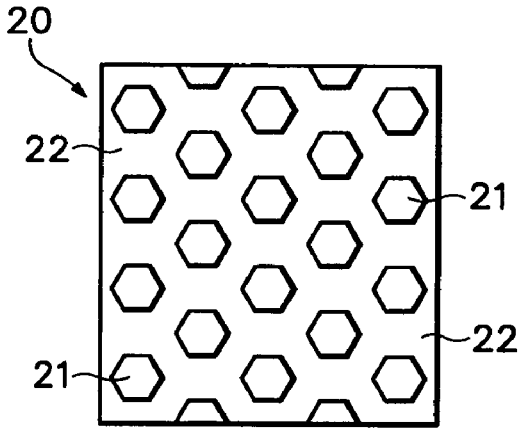
Figure 5E:
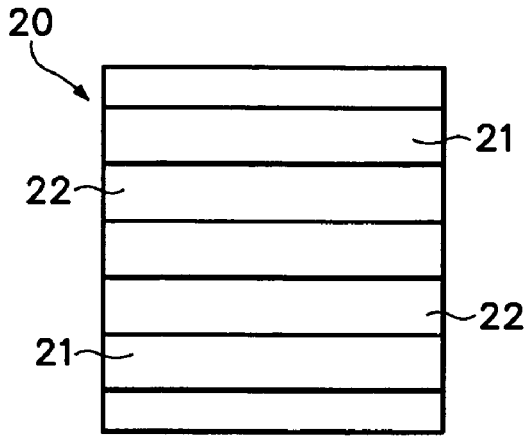
Figure 5F:
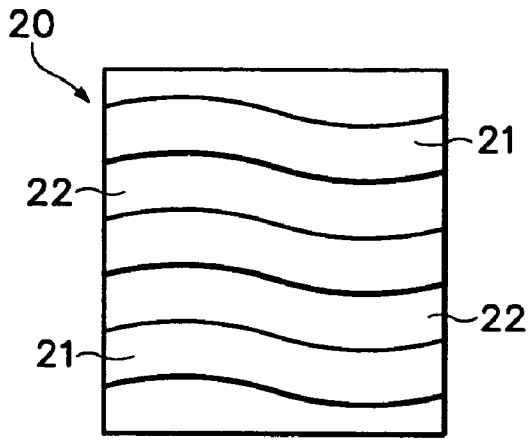
Figure 5G:
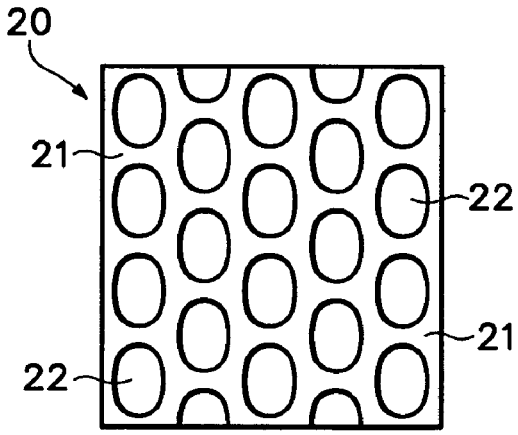
Figure 5H:
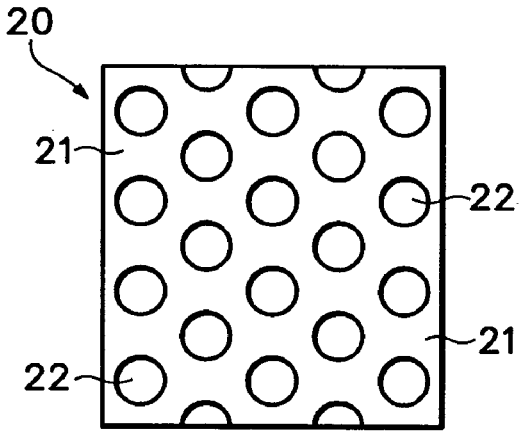

Embossed material 20 is incorporated into article of apparel 10 such that first surface 24*a* faces outward and second surface 24*b* faces inward. That is, extended regions 21 and compressed regions 22 are positioned in article of apparel 10 to form an interior surface of article of apparel 10. In this regards, extended regions 21 form areas of contact the individual, which is represented by reference numeral 14 in FIG. 4. In many conventional articles of apparel that incorporate an embossed material, the embossed surface of the embossed material faces outward to provide an aesthetic quality to the conventional articles of apparel. In article of apparel 10, however, extended regions 21 and compressed regions 22 (i.e., second surface 23*b*) face inward in order to enhance the performance and comfort of the individual. More particularly, extended regions 21 contact the individual, and compressed regions 22 form various spaces 24 between embossed material 20 and the individual. Spaces 24 may enhance performance by facilitating the movement of air, thereby promoting removal of perspiration. Spaces 24 may also enhance comfort by retaining heat and ensuring that embossed material 20 does not cling or otherwise significantly contact the individual. Accordingly, embossed material 20 is incorporated into article of apparel 10 such that extended regions 21 face inward to contact the individual, compressed regions 22 also face inward and form spaces 24, first surface 23 faces outward from the individual, and second surface 23*b* is generally positioned adjacent the individual.

Embossed material 20 is formed from a generally two-dimensional material. As utilized with respect to the present invention, the term "two-dimensional material" is intended to encompass a variety of materials exhibiting a length and a width that are substantially greater than a thickness. Accordingly, suitable materials for embossed material 20 include various textiles and polymer sheets, for example. Textiles, as discussed in the Background of the Invention section above, are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven fabric. Polymer sheets may be extruded, rolled, or otherwise formed from a polymer material to exhibit a generally flat aspect. In addition to textiles and polymer sheets, embossed material 20 may be formed from other two-dimensional materials, such as leather and synthetic suede.

A variety of materials are suitable for embossed material 20, including materials such as cotton, rayon, wool, and nylon, for example. The characteristics of embossed material 20, when formed as a textile, depend primarily upon the materials of the yarns that form embossed material 20. Cotton, for example, provides a soft hand, natural aesthetics, and biodegradability. Rayon provides high luster and moisture absorption. Wool also provides high moisture absorption, in addition to insulating properties. Nylon is a durable and abrasion-resistant material with high strength. In order to provide stretch and recovery properties, elastane fiber may be incorporated into embossed material 20. Elastane fibers are available from E.I. duPont de Nemours Company under the LYCRA trademark. Such fibers may have the configuration of covered elastane, wherein the fiber includes an elastane core that is surrounded by a nylon sheath. Other fibers or filaments exhibiting elastic properties may also be utilized. A plurality of other materials, whether elastic or inelastic, are also suitable for embossed material 20. Accordingly, the materials selected for embossed material 20 contribute to the properties of article of apparel 10.

In addition to the materials discussed above, embossed material 20 may be formed from any conventional fleece material. In some embodiments, embossed material 20 may incorporate textured and semi-dull polyester yarn. Polyester is a hydrophobic material that also provides relatively high durability. As an example, the face and back may be formed from polyester yarn having 150 denier and 96 filaments per yarn, and the tie may be formed from polyester yarn having 75 denier and 36 filaments per yarn. A relatively heavy weight version of embossed material 20 may be formed such that the face and back include polyester yarn having 100 denier and 144 filaments per yarn, and the tie may be formed from polyester yarn having 150 denier and 48 filaments per yarn. In another embodiment, embossed material 20 may be formed such that the face and back include polyester yarn having 100 denier and 144 filaments per yarn, and the tie may be formed from polyester yarn having 100 denier and 36 filaments per yarn. Accordingly, embossed material 20 may be formed from a variety of yarn combinations and configurations.

Article of apparel 10 is formed from a plurality of individual elements that are joined together through stitching, for example, to form the configuration of a jacket. That is, multiple elements of embossed material 20 may be joined together to form torso portion 11 and arm portions 12*a* and 12*b*. Each of the individual elements may be formed from embossed material 20. As an alternative, one or more of the elements may be formed from different materials. For example, the elements forming torso portion 11 may be formed from embossed material 20, whereas the elements forming arm portions 12*a* and 12*b* may be formed from a different two-dimensional material. As another alternative, each of the elements forming article of apparel 10 may be formed from embossed material 20, but the specific yarns forming each element of embossed material 20 may vary. Accordingly, the manner in which embossed material 20 is incorporated into article of apparel 10 may vary significantly within the scope of the present invention.

With reference to FIG. 2, extended regions 21 define a plurality of elongate protrusions on second surface 23*b*, with compressed regions 22 extending entirely around the protrusions. The dimensions and shapes of extended regions 21 and compressed regions 22 may vary significantly within the scope of the present invention. As depicted, extended regions 21 are elliptical in shape and have a width dimension that is approximately two-thirds of a length dimension. Accordingly, the length of each extended region 21 may be approximately 6 millimeters, with the width being approximately 4 millimeters. A suitable height for extended regions 21 that have a 6 millimeter length and 4 millimeter width is two millimeters, with the height being the distance from the portion of second surface 23*b* that forms compressed regions 22 to the portion of second surface 23*b* that forms extended regions 21. Following examination of various dimensions for extended regions 21 and compressed regions 22, these dimensions were found to provide particularly suitable drapability for apparel applications. One skilled in the relevant art will recognize, however, that extended regions 21 and compressed regions 22 may exhibit a variety of dimensions, in addition to the dimensions discussed above.

The dimensions of extended regions 21 and compressed regions 22 have an effect upon the properties of embossed material 20. As discussed in greater detail below, the air permeability of extended regions 21 is generally greater than the air permeability of compressed regions 22. Accordingly, modifications in the area ratio of extended regions 21 to compressed regions 22 may be utilized to control the overall air permeability of embossed material 20. The dimensions of extended regions 21 also have an effect upon the drapability of embossed material 20. The drapability of embossed material 20 is generally suitable when the various extended regions 21 exhibit a length that is less than 15 millimeters and a height less than 5 millimeters. These dimensions may vary, however, depending upon the thickness of embossed material 20, the materials forming embossed material 20, and various other factors.

Extended regions 21 may exhibit an elliptical shape, as discussed above. The specific configuration of extended regions 21 and compressed regions 22 may vary significantly, however, as depicted in FIGS. 5A-5H. Extended regions 21 may form round, square, triangular, or hexagonal shapes, for example, as depicted respectively in FIGS. 5A-5D. Extended regions 22 may also form straight or curved lines on embossed material 20, as depicted respectively in FIGS. 5E and 5F. In some embodiments, compressed regions 22 may form discrete areas of embossed material 20 having elliptical or round shapes, as depicted respectively in FIGS. 5G and 5H. In some other embodiments, extended regions 21 and compressed regions 22 may even be randomly-placed such that no distinct pattern is formed on second surface 23*b*. Accordingly, the pattern of extended regions 21 and compressed regions 22 on embossed material 20 may vary significantly within the scope of the present invention, and the pattern of extended regions 21 and compressed regions 22 on embossed material 20 may include a variety of configurations that are not specifically depicted in FIGS. 5A-5H.

Extended regions 21 are arranged such that adjacent rows are offset from each other. That is, the various extended regions 21 are depicted as not being arranged in a column and row configuration. Depending upon the specific materials utilized in embossed material 20, the shapes of extended regions 21, and various other factors, the offset configuration of extended regions 21 may impart enhanced drapability. Accordingly, the pattern of extended regions 21 may have an effect upon the overall drapability of embossed material 20.

Embossed material 20 may be formed through a generally conventional process. For example, the manufacturing process may initially involve heating one or both of a male and female roller that cooperatively form the shape of embossed material 20. A two-dimensional material then extends between the rollers such that the shape of embossed material 20 is formed in the two-dimensional material. That is, the rollers compress portions of the two-dimensional material in order to form compressed regions 22, and the rollers do not compress other portions in order to form extended portions 21. In general, a suitable material for embossed material 20 may be formed from yarns that incorporate thermoplastic materials. Accordingly, the heat from the rollers forms permanent impressions (i.e., compressed regions 22) in the two-dimensional material, thereby forming embossed material 20. Embossed material 20 is then incorporated into article of apparel 10 such that extended regions 21 and compressed regions 22 face inward, form space 24, and are positioned adjacent the individual.

Figure 6:
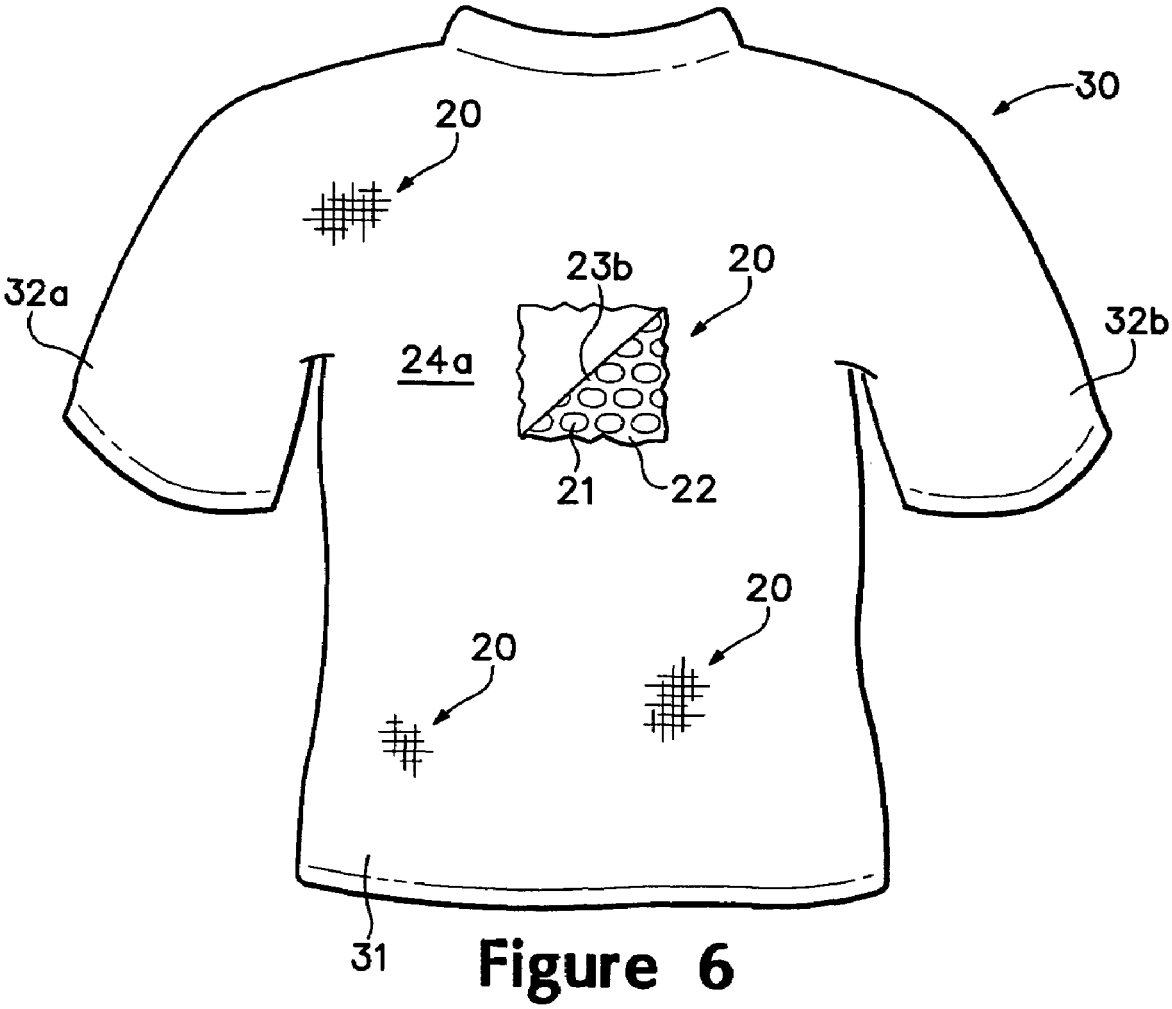
FIG. 6 is a front plan view of a another article of apparel incorporating the material.

With reference to FIG. 6, another article of apparel 30 is disclosed. Article of apparel 30 has the configuration of a short-sleeved shirt and includes a torso portion 31 and two arm portions 32*a* and 32*b*. Torso portion 31 corresponds with a torso of an individual and, therefore, covers the torso when worn. Similarly, arm portions 32*a* and 32*b* respectively correspond with a right arm and a left arm of the individual and cover the arms when worn. Article of apparel 30 exhibits, therefore, the general configuration of a conventional short-sleeved shirt. In contrast with the conventional short-sleeved shirt, however, article of apparel 30 is at least partially formed from embossed material 20. Accordingly, embossed material 20 is incorporated into article of apparel 30 such that first surface 23*a* faces outward and second surface 23*b* faces inward. That is, extended regions 21 and compressed regions 22 are positioned in article of apparel 30 to contact the individual and form a space between embossed material 20 and the individual.

Figure 7:
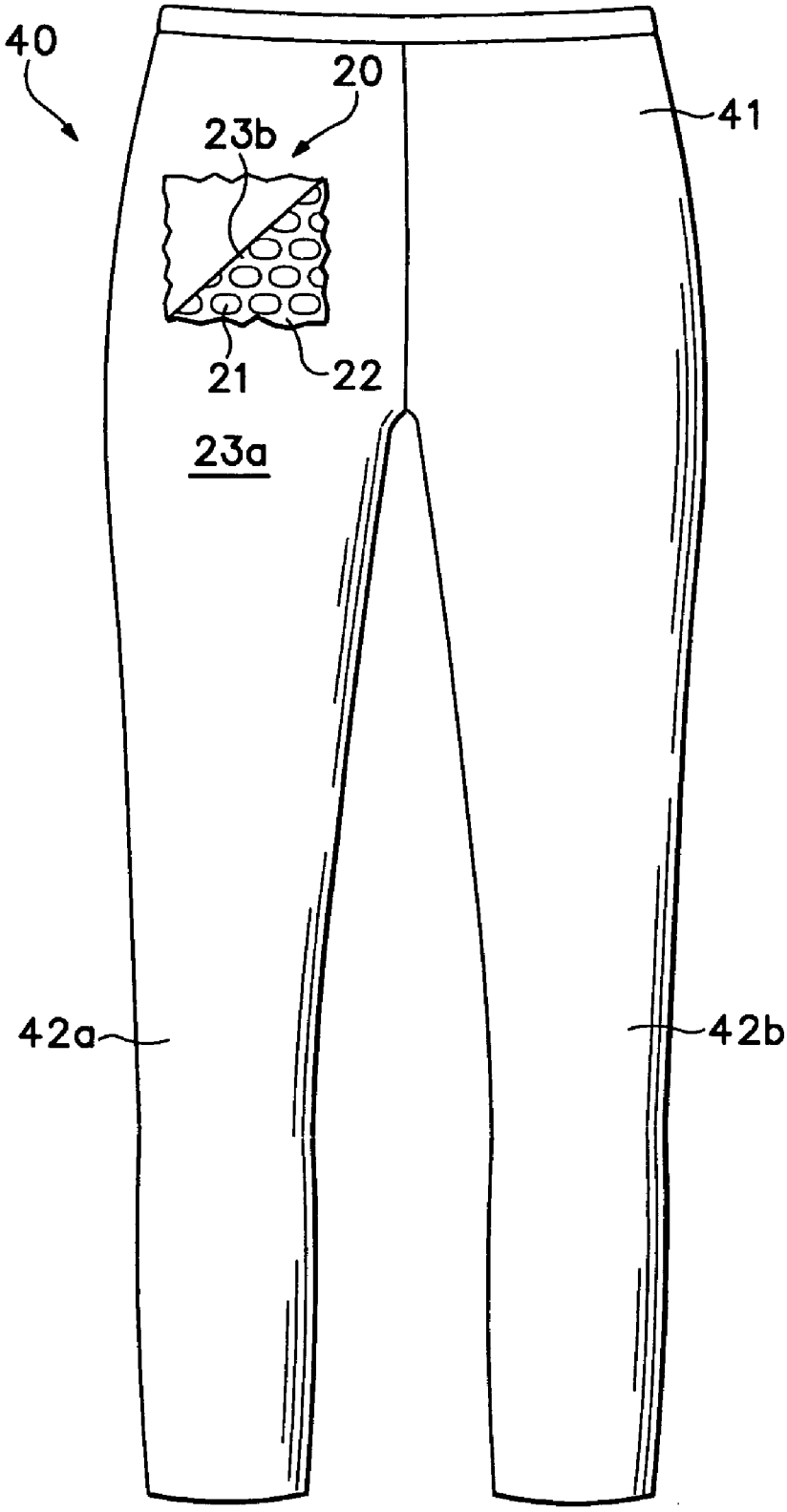
FIG. 7 is a front plan view of yet another article of apparel incorporating the material.

Another article of apparel 40 is depicted in FIG. 7 as having the configuration of a pair of pants. Article of apparel 40 includes a pelvic portion 41 and a pair of leg portions 42*a* and 42*b*. As with articles of apparel 10 and 30, article of apparel 40 incorporates embossed material 20 such that first surface 23*a* faces outward and second surface 23*b* faces inward. That is, extended regions 21 and compressed regions 22 are positioned in article of apparel 40 to contact the individual and form a space between embossed material 20 and the individual.

Based upon the above discussion, embossed material 20 may be incorporated into a variety of articles of apparel. The manner in which embossed material 20 is incorporated into articles of apparel may vary significantly within the scope of the present invention. In some embodiments, extended regions 21 are positioned to contact the individual. That is, the embossed portion of embossed material 20 faces inward. This configuration provides various advantages. For example, extended regions 21 contact the individual and form a space 24 between embossed material 20 and the individual. Space 24 may enhance performance by facilitating the movement of air, thereby promoting removal of perspiration. Space 24 may also enhance comfort by retaining heat and ensuring that embossed material 20 does not cling or otherwise significantly contact the individual. Accordingly, embossed material 20 may be incorporated into a variety of articles of apparel such that extended regions 21 face inward to contact the individual, compressed regions 22 also face inward and form spaces 24, first surface 23 faces outward from the individual, and second surface 23*b* is generally positioned adjacent the individual.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of apparel comprising:

an embossed material formed from a two-dimensional material, the embossed material having a first surface and an opposite second surface;

a plurality of extended regions that form protrusions on the second surface, said protrusions are solid or filled with the same material and at least one compressed region that forms an indentation in the second surface, the embossed material being incorporated into the article of apparel such that the extended regions face inward to form at least a portion of an interior surface of the article of apparel, and wherein the embossed material is a textile wherein the article of apparel fits at least a portion of an upper torso of a wearer and includes a neck opening and two arm openings.

2. The article of apparel recited in claim 1, wherein the extended regions are positioned to contact an individual wearing the article of apparel.

3. The article of apparel recited in claim 2, wherein the embossed material forms a space between the individual and the at least one compressed region.

4. The article of apparel recited in claim 1, wherein the at least one compressed region extends around the extended regions.

5. The article of apparel recited in claim 1, wherein the extended regions have an elongate configuration.

6. The article of apparel recited in claim 1, wherein the extended regions have an elliptical configuration.

7. The article of apparel recited in claim 1, wherein at least a portion of the extended regions have a length of approximately 6 millimeters, a width of approximately 4 millimeters, and a height of approximately 2 millimeters.

8. The article of apparel recited in claim 1, wherein the extended regions have a length that is less than 15 millimeters.

9. The article of apparel recited in claim 8, wherein the extended regions have a height that is less than 5 millimeters.

10. The article of apparel recited in claim 8, wherein a width of the extended regions is two-thirds the length.

11. An article of apparel comprising:

an embossed material formed from a two-dimensional material of a single layer, the embossed material having a first surface that is substantially flat and planar and an opposite second surface;

a plurality of extended regions that form protrusions on the second surface, the extended regions having an elongate configuration; and at least one compressed region that forms an indentation in the second surface, the compressed region extending around the extended regions, the embossed material being incorporated into the article of apparel such that the extended regions face inward to form at least a portion of an interior surface of the article of apparel, and the extended regions are positioned to contact an individual wearing the article of apparel and form a space between the individual and the at least one compressed region, wherein the embossed material is a textile wherein the article of apparel fits at least a portion of an upper torso of a wearer and includes a neck opening and two arm openings.

12. The article of apparel recited in claim 11, wherein the extended regions have an elliptical configuration.

13. The article of apparel recited in claim 11, wherein at least a portion of the extended regions have a length of approximately 6 millimeters, a width of approximately 4 millimeters, and a height of approximately 2 millimeters.

14. The article of apparel recited in claim 11, wherein the extended regions have a length that is less than 15 millimeters.

15. The article of apparel recited in claim 14, wherein the extended regions have a height that is less than 5 millimeters.

16. The article of apparel recited in claim 14, wherein a width of the extended regions is two-thirds the length.

17. An article of apparel comprising:

an embossed material including a first surface and an opposite second surface, the first surface being substantially planar;

a plurality of extended regions that form protrusions on the second surface, said protrusions are solid or filled with the same material, the extended regions having an elliptical configuration; and at least one compressed region that forms an indentation in the second surface, the at least one compressed region extending around the extended regions, at least a portion of the extended regions having a length of approximately 6 millimeters, a width of approximately 4 millimeters, and a height of approximately 2 millimeters, wherein the embossed material is a textile wherein the article of apparel fits at least a portion of an upper torso of a wearer and includes a neck opening and two arm openings.

18. An article of apparel comprising:

an embossed material including a two-dimensional material of a single layer having a first surface and an opposite second surface, the first surface being substantially flat and planar;

a plurality of extended regions that form protrusions on the second surface, the extended regions having an elongate configuration; and at least one compressed region that forms an indentation in the second surface, the at least one compressed region extending around the extended regions, at least a portion of the extended regions having a length that is less than 15 millimeters and a height that is less than 5 millimeters, wherein the embossed material is a textile wherein the article of apparel fits at least a portion of an upper torso of a wearer and includes a neck opening and two arm openings.

19. The embossed material recited in claim 18, wherein a width of the extended regions is two-thirds the length.

20. An article of apparel comprising:

an embossed material formed from a two-dimensional material, the embossed material having a first surface and an opposite second surface;

a plurality of extended regions that form protrusions on the second surface, the extended regions having an elongate configuration, the embossed material having a first density and a first thickness in the extended regions; and at least one compressed region that forms an indentation in the second surface, the compressed region extending around the extended regions and having a flat, planar surface between said protrusions, the embossed material having a second density and a second thickness in the compressed region, the first density being less than the second density and the second thickness being less than the first thickness, the embossed material being incorporated into the article of apparel such that the extended regions face inward to form at least a portion of an interior surface of the article of apparel, wherein the embossed material is a textile wherein the article of apparel fits at least a portion of an upper torso of a wearer and includes a neck opening and two arm openings.

21. The article of apparel recited in claim 20, wherein the extended regions have an elliptical configuration.

22. The article of apparel recited in claim 20, wherein at least a portion of the extended regions have a length of approximately 6 millimeters, a width of approximately 4 millimeters, and a height of approximately 2 millimeters.

23. The article of apparel recited in claim 20, wherein the extended regions have a length that is less than 15 millimeters.

24. The article of apparel recited in claim 23, wherein the extended regions have a height that is less than 5 millimeters.

25. The article of apparel recited in claim 23, wherein a width of the extended regions is two-thirds the length.

* * * * *

UNITED STATES PATENT AND TRADEMARK OFFICE

CERTIFICATE OF CORRECTION

PATENT NO. : 7,669,250 B2
APPLICATION NO. : 10/963745
DATED : March 2, 2010
INVENTOR(S) : Baron et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 761 days.

Signed and Sealed this
Twenty-eighth Day of December, 2010

David J. Kappos

David J. Kappos
*Director of the United States Patent and Trademark Office*